United States Patent [19]

Nishikawa et al.

[11] 4,053,769

[45] Oct. 11, 1977

[54] CORONA CHARGE DEVICE

[75] Inventors: Masaji Nishikawa; Muneo Kasuga, both of Hachioji, Japan

[73] Assignee: Olympus Optical Company Limited, Tokyo, Japan

[21] Appl. No.: 665,315

[22] Filed: Mar. 9, 1976

[30] Foreign Application Priority Data

Mar. 15, 1975 Japan ..... 50-31578

[51] Int. Cl.[2] ..... G03G 15/00

[52] U.S. Cl. ..... 250/324; 361/213

[58] Field of Search ..... 250/324, 325, 326; 317/262 A

[56] References Cited

U.S. PATENT DOCUMENTS

| | | | |
|---|---|---|---|
| 3,164,074 | 1/1965 | Francis | 250/325 |
| 3,483,372 | 12/1969 | Benson | 250/326 |
| 3,496,352 | 2/1970 | Jugle | 250/326 |
| 3,742,237 | 6/1973 | Parker | 250/324 |
| 3,813,548 | 5/1974 | Silverberg | 250/324 |

*Primary Examiner*—Craig E. Church

*Attorney, Agent, or Firm*—Haseltine, Lake & Waters

[57] ABSTRACT

A corona charge device which can charge a medium being charged such as a photoconductive body or a record sheet provided for a conventional electrographic apparatus. The device comprises a corona discharge wire connected to a high voltage source and a grounded shield electrode surrounding the corona discharge wire and composed of an elongate rectangular closed vessel which is open at its bottom wall to define an opening. The transverse width of the opening is reduced by two opposed elongate insulating plates secured to the side walls of the vessel.

2 Claims, 7 Drawing Figures

CORONA CHARGE DEVICE

THE FIELD OF THE INVENTION

This invention relates to corona charge devices and more particularly to a corona charge device which is small in size and highly efficient in operation.

BACKGROUND

Recently, various kinds of electrographic apparatuses have widely been used in practice. In general, the electrographic apparatus makes use of a medium being charged such as a photoconductive body or a record sheet and a device for charging such medium being charged.

As such charge device, it has been the common practice to use a corona charge device.

It is preferable to make the corona charge device small in size and highly efficient in operation. For this purpose, however, each of constitutional elements of the corona charge device must be small in size and highly efficient in operation.

In an effort to make the practical corona charge device small in size and highly efficient in operation, one attempt has been made to employ a small type shield electrode. However, if the shield electrode is made small in size, it is impossible to operate such small type shield electrode as an ion supply source in a stable manner without producing any spark discharge for lack of the insulating characteristic of air.

In an effort to make the practical corona charge device small in size and highly efficient in operation, another attempt has also been made to reduce the diameter of a corona discharge wire. A tungsten wire having a diameter of the order of 30 to 100 $\mu$ has frequently been used as the corona discharge wire. If the diameter of the corona discharge wire is reduced, corona is produced at a low voltage, and as a result, the small shield electrode can be used without producing any spark discharge. But, since the mechanical strength of a thin tungsten wire is low, there is a risk of the thin tungsten wire being broken thus requiring much maintenance. In an effort to make the practical corona charge device small in size and highly efficient in operation, further attempts have been made to coat the corona discharge wire with material which can efficiently emit a flow of ions or deform the corona discharge wire into a structure which is not rectilinear in form. All of these attempts, however, have the disadvantage that the use of such measures could not make the corona charge device stable in operation and less expensive.

SUMMARY OF THE INVENTION

An object of the invention, therefore, is to provide a corona charge device which is constructed on the basis of such a novel technique that can eliminate the above mentioned disadvantages of the conventional corona charge device and is small in size and highly efficient in operation.

Another object of the invention is to provide a corona charge device which can employ any desired size of medium being charged, such as a photoconductive body or a record sheet, without reducing an effective flow of ions toward a field electrode.

A feature of the invention is the provision of a corona charge device which comprises a corona discharge wire connected to a high voltage source and a grounded shield electrode composed of an elongate rectangular closed vessel which is open at its bottom wall to define an opening, the corona discharge wire being surrounded by the vessel and resiliently supported by each end wall of the vessel, a flow of ions being directed downwardly from said corona discharge wire through the opening toward a field electrode, the device comprising a member for controlling the flow of ions toward said field electrode and composed of an elongate insulating plate having upper and lower half portions, the upper half portion being secured to and extended along each side wall of the shield electrode and the lower half portion being inclined an angle with respect to the upper half portion to reduce a transverse width of the opening.

BRIEF DESCRIPTION OF THE DRAWING

The invention will now be described in greater detail with reference to the accompanying drawings, wherein.

DETAILED DESCRIPTION

Figure 1:
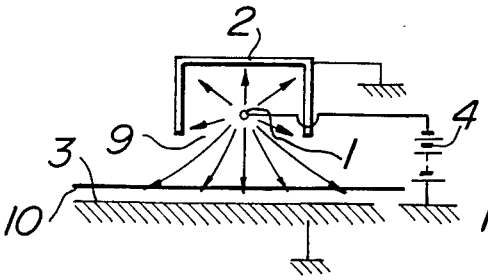
FIG. 1 is a cross sectional view showing a conventional corona charge device.

In FIG. 1 is shown a conventional corona charge device which has most frequently used in practice. Referring to FIG. 1, reference numeral 1 designates a corona discharge wire surrounded by a shield electrode 2. The shield electrode 2 is composed of an elongate rectangular closed vessel which is open at its bottom wall to define an opening 9. The corona discharge wire 1 is resiliently supported by each end wall of the vessel and a flow of ions is directed downwardly from the corona discharge wire 1 through the opening 9.

Positioned immediately below the opening 9 of the shield electrode 2 is a grounded field electrode 3.

The corona discharge wire 1 is connected through a high voltage source 4 to ground. The shield electrode 2 is also connected to ground.

If a high voltage is applied from the high voltage source 4 to the corona discharge wire 1, the shield electrode 2 causes a high electric field to be produced around the corona discharge wire 1, thereby producing corona discharge.

A flow of ions thus produced is directed to the shield electrode 2 on the one hand and directed through the opening 9 to the field electrode 3 on the other hand.

In this case, if a medium being charged 10 such as a photoconductive body or a record sheet of a conventional electrographic apparatus is positioned in overlying contact with the field electrode 3, it is possible to charge the medium being charged 10.

The flow of ions toward the field electrode 3 is effective to charge the medium being charged 10. But, this effective flow of ions is diverged to a transverse width which is considerably wider than that of the shield electrode 2. The extent of divergence of the effective flow of ions is different in dependence with the position of the field electrode 3 and the value of voltage applied from the high voltage source 4 to the corona discharge wire 1 and usually becomes a width which is approximately two times wider than the width of the shield electrode 2.

The conventional corona charge device constructed as above described takes up much space which is approximately two times larger than the width of the shield electrode 2. This hinders the corona charge device from becoming small in size.

Provision may be made of a shield plate and the like arranged near the field electrode 3 for the purpose of reducing the effective width of the flow of ions. The presence of the shield plate, however, results in a decrease of the charging capacity of the corona charge device by a factor which corresponds to the reduced effective width. Eventually, the presence of the shield plate and the like prevents the medium being charged 10 such as the record sheet from being freely passed over the field electrode 3, thereby stopping continuous feed of the record sheet.

Figure 3:
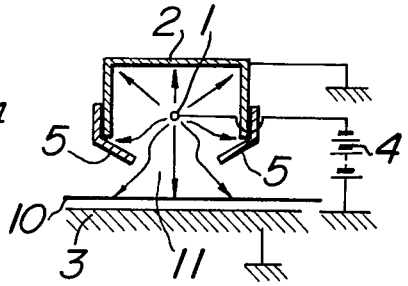
FIG. 3 is a cross sectional view taken on line III—III in FIG. 2.
Figure 2:
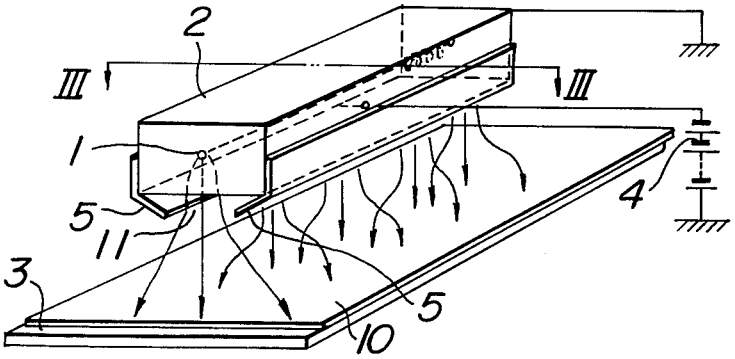
FIG. 2 is a perspective view showing an embodiment of the corona charge device according to the invention wherein a shield electrode is provided at its side walls with insulating plates whose lower half portions are inclined at an angle with respect to an upper half portion to reduce an opening.

In FIGS. 2 and 3 is shown one embodiment of the corona charge device according to the invention. In the present embodiment, provision is made of a member for controlling the effective flow of ions toward the field electrode 3 and composed of an elongate insulating plate 5 having an upper half portion secured to and extended along each side wall of the shield electrode 2 and a lower half portion inclined an angle with respect to the upper half portion to reduce a transverse width 11 of the opening 9 of the shield electrode 2. The insulating plates 5, constructed as above described serve to deflect the electric field. That is, as soon as the corona discharge wire 1 produces corona discharge, a portion of the flow of ions toward the shield electrode 2 charges the insulating plates. This electric charge acts upon the electric field, and as a result, the flow of ions is deflected toward the center of the opening 9 of the shield electrode 2 as shwon by arrows in FIGS. 2 and 3.

Heretofore, it has been proposed to bend the opposed lower peripheral edges of the shield electrode 2 of the corona charge device toward the center of the opening 9 of the shield electrode 2. Such conventional structure, however, could not deflect the flow of ions.

On the contrary, the invention makes use of the insulating plates 5, and of the deflecting action of the electric charge produced on the insulating plates 5, so as to deflect the flow of ions toward the center of the opening 9 of the shield electrode 2. Thus, it is possible to convert the flow of ions diverged in a low density condition into a flow of ions concentrated in a high density condition.

Figure 4:
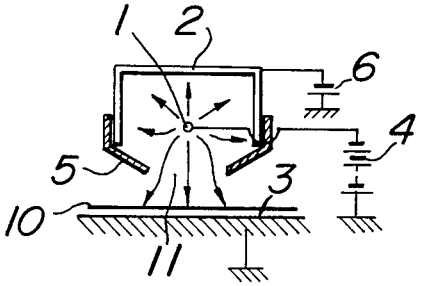
FIG. 4 is a cross sectional view showing a modified embodiment of the corona charge device shown in FIGS. 2 and 3 wherein the shield electrode is connected through a bias voltage source to ground.

In FIG. 4 is shown a modified embodiment of the corona charge device shown in FIGS. 2 and 3.

In the present embodiment, the shield electrode 2 is connected through a bias voltage source 6 to ground. The bias voltage source 6 serves to apply a constant electric potential to the shield electrode 2. If the electric potential applied to the shield electrode 2 by means of the bias voltage source 6 approaches the electric potential applied to the corona discharge wire 1 by means of the high voltage source 4, corona electric current per se becomes decreased, but substantially no change occurs in the effective flow of ions toward the field electrode 3. The electric field in a direction from the corona discharge wire 1 toward the field electrode 3 is intensified, so that the insulating plates 5, provided for reducing the transverse width of the opening 9 of the shield electrode 2 becomes more effective. As a result, the flow of ions is more highly concentrated and impinged upon the field electrode 3.

The embodiment shown in FIG. 4 has further advantage that if it is desired to make current flowing toward the field electrode 3 the same and if the difference between the electric potential applied to the corona discharge wire 1 and the electric potential applied to the shield electrode 2 is made small, there is no risk of spark discharge, the total amount of current becomes small, so that the high voltage source 4 can be made small in size, and there is no risk of the corona discharge wire 1 being subjected to the spark discharge even when a higher voltage is applied thereto, so that the corona charge device shown in FIG. 4 can obtain a charge current which is larger than that obtained by the corona charge device shown in FIGS. 2 and 3, provided both corona charge devices are the same in size.

Figure 5:
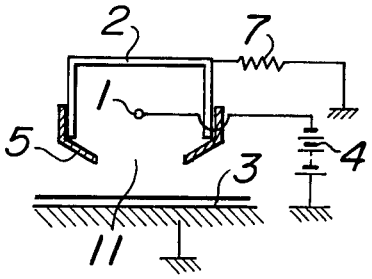
FIG. 5 is a cross sectional view showing another modified embodiment of the corona charge device shown in FIGS. 2 and 3 wherein the shield electrode is connected through a resistor to ground.

In FIG. 5 is shown another modified embodiment of the corona charge device shown in FIGS. 2 and 3. In the present embodiment, the shield electrode 2 is connected through a resistor 7 to ground. If electric current flows from the shield electrode 2 through the resistor 7 to ground, this electric current produces voltage across the resistor 7 to apply a suitable electric potential to the shield electrode 2. The resistor 7 has its optimum resistance value, which is different, dependent on the construction of the corona charge device and the voltage applied to the corona charge wire 1 from the high voltage source 4. The present modified embodiment shown in FIG. 5 has the advantage that the bias voltage source 6 that is used in the modified embodiment shown in FIG. 4 is not required for the shield electrode 2, and that if the corona current is increased or decreased in response to change of the high voltage source 4, the voltage produced across the resistor 7 becomes charged in response thereto to produce such feed back action as to make the charge of the corona current small.

Figure 6:
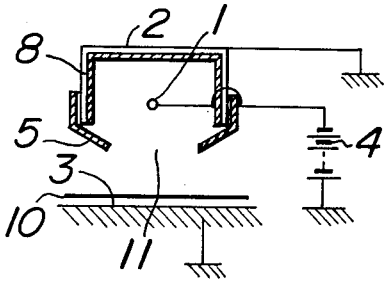
FIG. 6 is a cross sectional view showing a further modified embodiment of the corona charge device shown in FIGS. 2 and 3 wherein the shield electrode is provided at its inner walls with an insulating layer coated thereon.

In FIG. 6 is shown a further modified embodiment of the corona charge device shown in FIGS. 2 and 3. In the present embodiment, the shield electrode 2 is provided at its inner wall surface with an insulating layer 8 coated thereon. The insulating layer 8 has a leak resistance which is inherent to general property of insulating material per se. This leak resistance is rapidly decreased to a small value as the voltage applied to the corona charge wire 1 from the high voltage source 4 is increased. As a result, if the flow of ions from the corona discharge wire 1 arrives at the surface of the insulating layer 8, a constant surface electric potential is applied to the surface of the insulating layer 8, the constant surface electric potential being determined by the thickness and material of the insulating layer 8. This surface electric potential is stabilized at a value at which the leak resistance inherent to the property of the insulating material and the corona current are balanced with each other.

As seen from the above, the present modified embodiment shown in FIG. 6 has the advantage that if the corona current is increased or decreased in response to charge of the high voltage source 4. Such feed back operation is effected as to make the density of the flow of ions constant.

The operating characteristics of the conventional corona charge device shown in FIG. 1 will now be described in comparison with those of the above mentioned embodiments of the corona charge device according to the invention.

If a high voltage of 10 KV is applied to the corona discharge wire 1 of the conventional corona charge device shown in FIG. 1, ion current of approximately 270 μA flows from the corona discharge wire 1 toward the field electrode 3, while ion current of 1,150 μA flows from the corona discharge wire 1 toward the shield electrode 2. In addition, the width of the charged medium 10 is 45 mm and the charged condition at the edge portion of the charged medium 10 becomes unclear.

On the contrary, if a high voltage of 10 KV is applied to the corona discharge wire 1 of the corona charge device according to the invention shown in FIGS. 2 and 3, which comprises the shield electrode 2 provided at its side walls with the insulating plates 5, which form a reduced opening 11 of 5 mm and each formed of hard vinyl chloride, the lower half portion of which is inclined 30° with respect to the upper half portion, corona current of 300 μA flows from the corona discharge wire 1 to the field electrode 3, while ion current of 1,200 μA flows from the corona discharge wire 1 toward the shield electrode 2. In addition, the width of the charged medium 10 is 30 mm and the charged condition at the edge portion of the charged medium 10 is unclear.

In addition, if the shield electrode 2 is connected through a resistor 7 of 20 MΩ to ground as shown in FIG. 5, ion current of 220 μA flows from the ion discharge wire 1 toward the field electrode 3, while ion current of 150 μA flows toward the shield electrode 2. The width of the charged medium 10 is 22 mm.

In the corona charge device shown in FIG. 5, if the lower half of the insulating plate 5 is inclined 90° with respect to the upper half of the insulating plate 5, ion current of 200 μA flows from the ion discharge wire 1 toward field electrode 3, while ion current of 150 μA flows from the ion discharge wire 1 toward the shield electrode 2. The width of the charged medium 10 is 20 mm.

Figure 7:
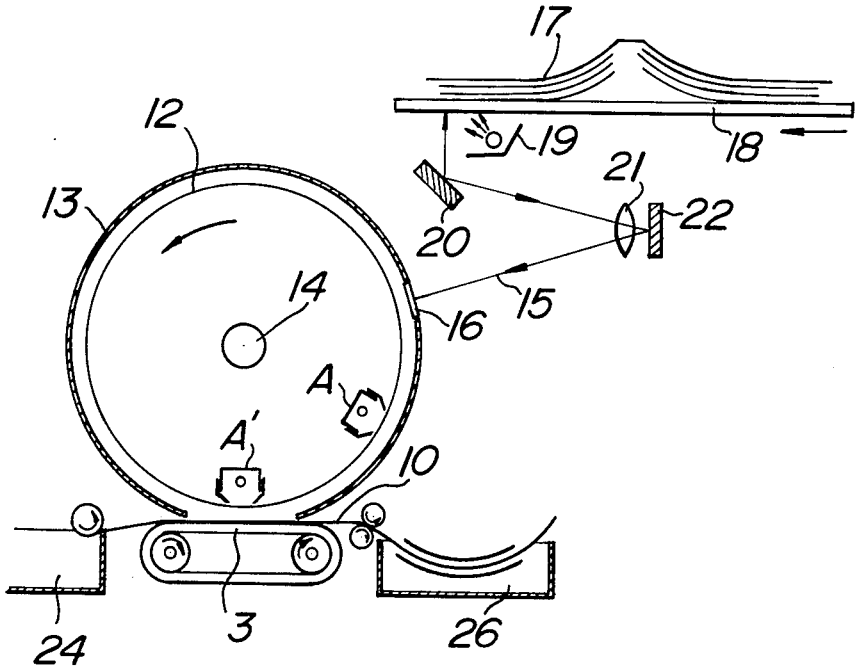
FIG. 7 is a schematic illustration of the corona charge device according to the invention which is applied to a conventional electrographic apparatus.

In FIG. 7 is shown two corona charge devices according to the invention applied to a conventional screen drum type electrographic apparatus which includes a photoconductive screen drum 12 surrounded by a cover 13 and adapted to be rotated about a shaft 14 in a counterclockwise direction shown by the arrow. The first and second corona charge devices A, A′ are arranged along the inner periphery of the screen drum 12. The first corona charge device A serves to charge a photoconductive body provided for the screen drum 12 and constituting the field electrode 3. The charged photoconductive body of the photosensitive screen 12 is then illuminated by a light 15 through a window 16 provided for the cover 13, the light 15 corresponding to a light image to be recorded. Printed matter 17 to be reproduced is disposed on a table 18 and illuminated by a light emitted from an illumination device 19. A light reflected from the printed matter 17 is illuminated through a reflecting mirror 20, a projection lens 21 and a reflecting mirror 22 upon the screen drum 12. The charge on the photoconductive body of the screen drum 12 is discharged in correspondence with the incident light 15 to form an electrostatic latent image thereon. The screen drum 12 is further rotated and located at a position opposed to the second corona charge device A′. The flow of ion emitted from the second corona charge device A′ and directed through the openings in the screen drum 12 toward a record sheet 23 is modulated in response to the electrostatic latent image on the photoconductive body of the screen drum 12 to form a corresponding latent image on the record sheet 23. This record sheet 23 is transferred from a feeding device 24 through an endless belt constituting the field electrode 3 to a developing tank 26 in which the electrostatic latent image on the record sheet 23 becomes visible.

As explained hereinbefore, the corona charge device according to the invention has a number of advantages. In the first place, it is possible to limit the region of the medium being charged on which the flow of ions is projected to a necessary width. Secondly, the density of the effective flow of ions toward a field electrode can be made high. Third, ion current which flows from a corona discharge wire toward a shield electrode can be decreased, so that the high voltage source can be made small in size. Fourth, the dielectric breakdown voltage between the shield electrode and the corona discharge wire can be designed under favourable conditions. Finally, the density of the effective flow of ion toward a field electrode can be stabilized irrespective of change of the voltage of the high voltage source.

What is claimed is:

1. A corona charge device comprising a corona discharge wire connected to a high voltage source and a grounded conductive shield electrode including an elongate rectangular closed vessel including side walls and end walls, said vessel being open at its bottom between opposed side walls to define an opening, the corona discharge wire being surrounded by said vessel and being resiliently supported by said end walls of said vessel such that a flow of ions is directed downwardly from said corona discharge wire through said opening toward a field electrode, said device further comprising means for controlling the flow of ions toward said field electrode including elongate insulating plates each having upper and lower half portions, said upper half portions being respectively secured to and extending along each side wall of said conductive shield electrode and said lower half portion being inclined at an angle with respect to said upper half portion to reduce the transverse width of said opening, means for maintaining said insulating plates at an electric potential which is higher than the electric potential of said grounded conductive shield electrode and means for setting an electrical potential of at least the inner surface of said shield electrode to an electrical potential between the electrical potential applied from said high voltage source to said corona discharge wire and ground electrical potential.

2. A corona charge device as claimed in claim 1, wherein said electrical potential setting means of said shield electrode is an insulating layer on the inner surface of said shield electrode.

* * * * *